US007424816B2

(12) United States Patent
Potthoff

(10) Patent No.: US 7,424,816 B2
(45) Date of Patent: Sep. 16, 2008

(54) ROLL STAND FOR ROLLING BAR-SHAPED OR TUBULAR STOCK

(75) Inventor: Heinrich Potthoff, Hilden (DE)

(73) Assignee: Kocks Technik GmbH & Co., Hilden (DE)

( * ) Notice: Subject to any disclaimer, the term of this patent is extended or adjusted under 35 U.S.C. 154(b) by 157 days.

(21) Appl. No.: 10/672,320

(22) Filed: Sep. 26, 2003

(65) Prior Publication Data

US 2004/0112107 A1 Jun. 17, 2004

(30) Foreign Application Priority Data

Sep. 30, 2002 (DE) ..... 102 45 854
Feb. 7, 2003 (DE) ..... 103 05 039

(51) Int. Cl.
*B21B 31/02* (2006.01)
*B21B 13/10* (2006.01)

(52) U.S. Cl. ..... 72/224; 72/235; 72/237; 72/244

(58) Field of Classification Search ..... 72/224, 72/235, 237, 238, 239, 246, 247, 248, 244
See application file for complete search history.

(56) References Cited

U.S. PATENT DOCUMENTS 3,861,187 A * 1/1975 Leeuwestein ..... 72/224
4,114,416 A * 9/1978 Bier et al. ..... 72/238
4,313,325 A * 2/1982 Staat et al. ..... 72/208
4,569,217 A * 2/1986 Properzi ..... 72/206
5,800,088 A * 9/1998 Luckhof et al. ..... 403/349
6,490,901 B2 * 12/2002 Potthoff ..... 72/224
6,502,446 B2 * 1/2003 Potthoff ..... 72/224
2001/0027674 A1 * 10/2001 Potthoff ..... 72/224
2001/0035037 A1 * 11/2001 Potthoff ..... 72/224
2002/0134127 A1 * 9/2002 Takeda et al. ..... 72/239

FOREIGN PATENT DOCUMENTS

DE 37 03 756 A1 8/1988
GB 1 440 633 6/1976

* cited by examiner

*Primary Examiner*—Dmitry Suhol
(74) *Attorney, Agent, or Firm*—Cook Alex Ltd.

(57) ABSTRACT

A roll stand for rolling bar-shaped or tubular stock, having a stand housing, having at least one roll which is arranged on a roll shaft rotatably mounted in the stand housing and is connected in a rotationally fixed manner to the roll shaft via a frictional connection, in which roll stand the roll is held in its axial position on the roll shaft in a positive-locking manner by sleeve elements adjoining axially with respect to the roll shaft.

14 Claims, 4 Drawing Sheets

ROLL STAND FOR ROLLING BAR-SHAPED OR TUBULAR STOCK

The invention relates to a roll stand for rolling bar-shaped or tubular stock. In particular, the invention relates to a roll stand having at least three rolls arranged in a star shape and together forming a calibrating opening.

Such roll stands are used in order to roll bar-shaped or tubular stock. In this case, a roll adapted at its engagement surface to the bar-shaped or tubular stock is arranged on a roll shaft rotatably mounted in a stand housing.

It is known from German Laid-Open Specification 2 259 143 to connect the roll to the roll axis in a rotationally fixed manner via an interference fit having a taper seat. Described there is the way in which this interference fit is released by forcing oil or another suitable pressure fluid under high pressure between the conical surface of the roll and the roll shaft via a bore system. In this way, those surfaces of the roll and the roll shaft which face one another are forced apart, so that the interference fit is released.

The long roll change times are a disadvantage with such a connection. Thus, in a similar manner to the dismantling of the roll, the interference fit is produced with the assistance of an oil film. When an oil film is present, the hub of the roll is pushed onto the roll shaft and positioned there axially. In order to produce the fixed interference fit, however, the oil must escape from the gap between roll and roll shaft. The oil is certainly gradually forced out of the gap by the forces acting in the interference fit. However, experience shows that this takes at least 30 minutes. During this time, the roll must be held in the axial position on the roll shaft by means of clamps, since the roll otherwise tends to move out of the axial position into a position having lower stress ratios. The attachment of the clamps holding the roll axially on the roll shaft, in addition to the prolongation of the roll change, results in the stand with the projecting clamps being difficult to handle.

Furthermore, said German Laid-Open Specification discloses a connection between the roll and the roll shaft which permits a quicker roll change. A roll ring which is held between two clamping disks is provided for this purpose. These clamping disks are mounted on a two-piece roll, a rolling-contact bearing axially adjoining the clamping disks at the respectively free ends of the latter. Correspondingly arranged shoulders of the two sectional shafts means that, by a tie rod which passes through the roll shaft being screwed in and by the associated adjusting movement of the sectional shafts relative to one another, an axial load is produced on the clamping disks, by means of which axial load the clamping disks are held in a positive-locking manner. In practice, however, it has been found that this arrangement is not suitable for the transmission of high torques and rolling forces.

Against this background, the object of the present invention is to provide a roll stand which permits the transmission of high torques from the roll shaft to the roll, the absorption of high rolling forces and a quick roll change.

This object is achieved by the subject matter of the independent claims. Advantageous configurations are specified in the subclaims.

The basic idea of the invention is to create a connection between roll shaft and roll, this connection being readily suitable for transmitting torques and rolling forces, by a frictional connection, preferably by an interference fit, in particular an interference fit having a taper seat, but at the same time to create an axial fixing of the roll on the roll shaft by sleeve elements axially adjoining the roll, which fixing is necessary for a quick roll change, can be set quickly and acts in a positive locking manner. This prevents the roll from moving out of its axial position on the roll shaft during the settling of the interference fit. External clamps which hold the roll in this position are not necessary. As a result, on a roll stand which has rolls which have just been exchanged and in which the load-bearing capacity of the interference fit increases by the oil being gradually displaced from the interference position, other working steps which are necessary in any case can at the same time already be carried out during the settling of the interference fit. In particular, an axial fine adjustment of the roll sitting on the roll shaft may already be effected relative to the stand surrounding it.

The term "roll" refers to any body of rotation which has a partial surface adapted for the rolling of bar-shaped or tubular stock and can be pushed onto a roll shaft. In this case, the partial surface of the roll for rolling the bar-shaped or tubular stock preferably interacts with partial surfaces of adjacent rolls. The roll may consist of a plurality of components, in particular a hub and a roll ring sitting on the hub, it being possible for the roll ring to be connected to the hub in a rotationally fixed manner. A rotationally fixed connection may be effected, for example, by joining processes, for example adhesive bonding, an interference fit or a slot-and-key arrangement.

The term "roll shaft" refers in particular to any element which can rotatably mount a shaft, sitting on it, in a stand housing. The roll shaft is preferably of one-piece design. However, it may also be composed of a plurality of sections.

The term "rotationally fixed connection" refers to a connection in which one body is connected to another body in such a way that it rotates with the other body about the same axis of rotation when one body rotates.

The term "sleeve element" refers to elements which can be put onto the roll shaft so that, directly adjoining the roll, they hold the latter in its axial position on the roll shaft in a positive-locking manner. In this case, the sleeve elements are in particular tubular bodies of rotation which can be pushed onto the roll shaft, for example bearing shells of rolling-contact bearings. However, sleeve elements axially fixing the roll may also denote clamping rings, pins or other elements which can be releasably connected in a fixed manner to a correspondingly designed roll shaft. The term "sleeve element" also refers in particular to a sleeve onto which a bearing shell of a rolling-contact bearing can be put.

In a preferred embodiment of the invention, the roll is connected to the roll shaft via an interference fit, in particular via an interference fit having a taper seat. The roll may of course also be connected to the roll shaft via thermally produced interference fits for example. However, an interference fit having a taper seat is preferred, since this interference fit enables the roll to be pushed axially onto the roll shaft in a simple manner. In this case, the taper seat may be produced by a conically designed inner surface of the roll, a conically designed outer surface of the roll or by both a conically designed inner surface of the roll and a conically designed outer surface of the roll shaft.

In order to permit simple release of the interference fit, provision is made in a preferred embodiment of the invention for a fluid medium supply which has an outlet in the region of the interference fit in order to introduce a fluid between roll and roll shaft. The fluid used in this case is preferably oil, which is introduced into the intermediate space between roll and roll shaft at 3000 to 4000 bar, preferably 3600 bar. As a result, the inner surface of the roll is forced away from the outer surface of the roll shaft, thereby releasing the interference fit. The fluid medium supply may be directed in any desired manner, but is preferably arranged in the roll shaft and is fed with fluid if required via an inlet provided at an exposed end of the roll shaft.

In a preferred embodiment, at least one of the sleeve elements axially fixing the roll by positive locking is connected to the roll shaft via an interference fit, in particular the interference fit having a taper seat described above. As a result, the fixing of the sleeve element on the roll shaft can also be quickly released, so that the roll can be quickly released from the roll shaft in the event of dismantling.

The neutralizing of the interference connection of the sleeve elements during the dismantling of the roll is facilitated if the push-on path of the interference fit of the sleeve element is smaller than the push-on path of the interference fit of the roll. In this case, the term "push-on path" refers to the axial distance which a body sitting loosely on the roll shaft has to cover in order to reach the position of the interference fit. In particular in the design of the interference fit having a taper seat, axial forces act between the roll shaft and the body sitting on the roll shaft when the interference fit is neutralized by the oil film. These forces cause the body to be moved out of the position of the interference fit into the freely movable position along the push-on path. If the push-on path of the interference fit of the sleeve element is now smaller than the push-on path of the interference fit of the roll, the restoring force of the interference fit of the roll may be used to release the interference fit of the sleeve element. Thus only the interference fit of the roll needs to be neutralized by the introduction of fluid, since the restoring forces produced as a result are sufficient to release the interference fit of the sleeve element.

According to an advantageous embodiment of the invention, a tie rod passing through the roll shaft is provided. This tie rod can preferably have at its one end an abutment transmitting axial forces at least in one axial direction of the roll shaft from the tie rod to one of the sleeve elements. As a result, tensile loads of the tie rod can be used to transmit axial forces via the abutment to the sleeve element and hold the latter in its axial position. In order to hold the tie rod in its position relative to the roll shaft, it is expedient to provide at the other end of the tie rod an abutment transmitting axial forces at least in the opposite axial direction of the roll shaft from the tie rod to the roll shaft. This abutment is preferably designed to be easily releasable. In particular, the abutment is formed by an external thread formed on the end of the tie rod and a nut bearing against the end of the roll shaft and screwed onto the external thread.

The tie rod provided in the roll shaft and holding the sleeve element axially on the roll shaft permits controlled dismantling and installation of the roll. The abutment holding the tie rod relative to the roll shaft may be designed in such a way that it can be released in a controlled manner by itself or by suitable means put on from outside. As a result, the axial retaining means of the sleeve element is released in a controlled manner. In particular when the interference fit of the roll on the roll shaft is released, this has the advantage that the large restoring forces produced as a result can be controlled. By slow release of the abutment, the restoring forces, by axial displacement of the roll and the sleeve elements, are reduced relative to the roll shaft gradually freed in its axial mobility.

The sleeve element may be designed, for example, in one piece as a cap having a rim of sleeve-like design or in several pieces, for example, with a cap acting on a sleeve, for example a bearing shell of a radial bearing.

According to one advantageous development of the invention, the abutment transmitting axial forces at least in one axial direction of the roll shaft from the tie rod to one of the roll elements is formed by a cap which encloses the end of the roll shaft, axially adjoins one of the sleeve elements and has a central recess in which the tie rod engages. In this case, the recess is preferably provided with an internal thread in which an external thread provided on the associated end of the tie rod engages.

Furthermore, quick roll change is made possible if, in a roll stand for rolling bar-shaped or tubular stock, having a stand housing, having at least one roll which is arranged on a roll shaft rotatably mounted in the stand housing and arranged in a recess of the housing, and having a retaining means releasably fixing the roll shaft at least in one axial direction in the recess, the retaining means is designed as a bayonet catch. To change the roll, it is necessary to at least partly pull the roll shaft out of the recess, surrounding it, of the housing in order to therefore free the hub of the roll. A retaining means of the roll shaft in the housing is formed by the use of a bayonet catch, this retaining means being robust with regard to axial loads on the one hand but being easily releasable on the other hand.

To protect the bayonet catch against unintentional opening, a preferred embodiment of the invention provides for a clamping means which acts on at least one component of the bayonet catch and prevents opening of the bayonet catch. This clamping means is in particular a screw which exerts a surface force on a component of the bayonet catch and thus prevents rotation of this component, as would be necessary for releasing the bayonet catch. As an alternative to the clamping means, a locking means acting in a positive-locking manner, for example a pin engaging in corresponding openings, may preferably be used.

The bayonet catch is preferably designed in such a way that it permits axial setting of the retaining means, axially fixing the roll shaft, relative to the one side of the bayonet catch. This nonetheless makes it possible for the roll shaft to be axially set in the retaining means retaining it axially. This is expedient, for example, in order to carry out a fine setting of the roll.

A preferred embodiment of the invention therefore preferably has a roll stand which comprises a ring element connected to an intermediate piece and having a recess which is provided on the outer circumference and enables a lug connected to the stand housing to pass through, this lug projecting beyond the outer circumference of the ring element toward the center axis of the ring element, and a connection between ring element and intermediate piece having connecting positions arranged axially next to one another and a mounting axially fixing the roll shaft in the intermediate piece and allowing rotation of the roll shaft relative to the intermediate piece.

The roll stand is preferably designed in such a way that the roll shaft is rotatably mounted in an eccentric sleeve, the eccentric sleeve being rotatably mounted in a recess of the stand housing. The roll axis can thus be adjusted in the radial direction in an infinitely variable manner by rotation of the eccentric sleeve.

In a preferred embodiment, a stepped seat is provided between an element fixed axially on the roll shaft and an element fixed axially to the stand housing. This stepped seat is provided in particular between the intermediate piece and the eccentric sleeve surrounding the intermediate piece. The stepped seat makes it possible to guide the roll shaft with sufficient play, without causing it to jam, when being pushed axially into the recess provided in the stand housing.

The term "stepped seat" refers to a fit between two areas in which a step is provided on in each case one end of an area, this step forming a tight fit with the surface having the associated end of the respective other area. In the regions next to the step, the fits are designed to be larger, so that the areas can be moved here freely against one another. The steps are arranged in each case at opposite ends of the areas, so that, when the areas are pushed one over the other, the step of the one area comes into contact with the surface of the respective other area only during virtually complete overlapping.

According to the invention, the roll sitting on the roll shaft is dismantled in such a way that a fluid is introduced into the frictional connection between roll and roll shaft and the positive-locking fixing of the roll is released by gradual release of an axial fixing of at least one of the sleeve elements.

In particular, the tensile stress of the tie rod axially retaining the sleeve element is reduced gradually, for example according to a ramp function. The gradual reduction of the axial retention of the positive-locking fixing prevents large restoring forces from leading to abrupt relative movements between the roll and the roll shaft, these restoring forces being produced when fluid is introduced into the frictional connection between roll and roll shaft. As a result, damage is avoided in particular when the fluid introduced between roll and roll shaft has still not reached all the regions of the contact areas. Surface damage would otherwise occur at this point.

The gradual release of the positive-locking fixing is preferably not completed until the fluid has reached all the regions of the contact areas between roll and roll shaft.

The invention is explained in more detail below with reference to a drawing showing only one exemplary embodiment in more detail. In the drawing.

Figure 1:
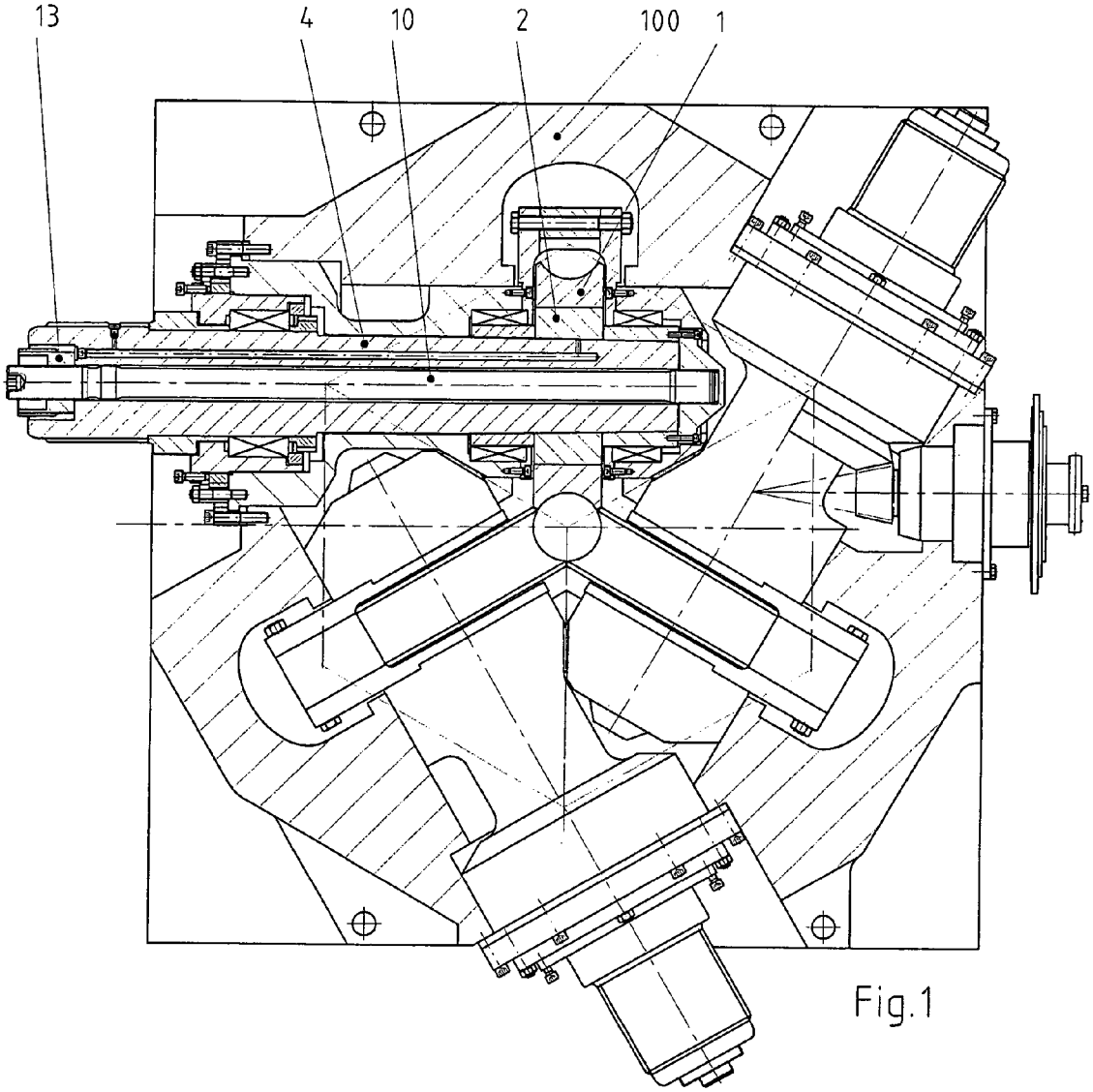
FIG. 1 shows a roll connected to a roll shaft in an axial cross section.
Figure 2:
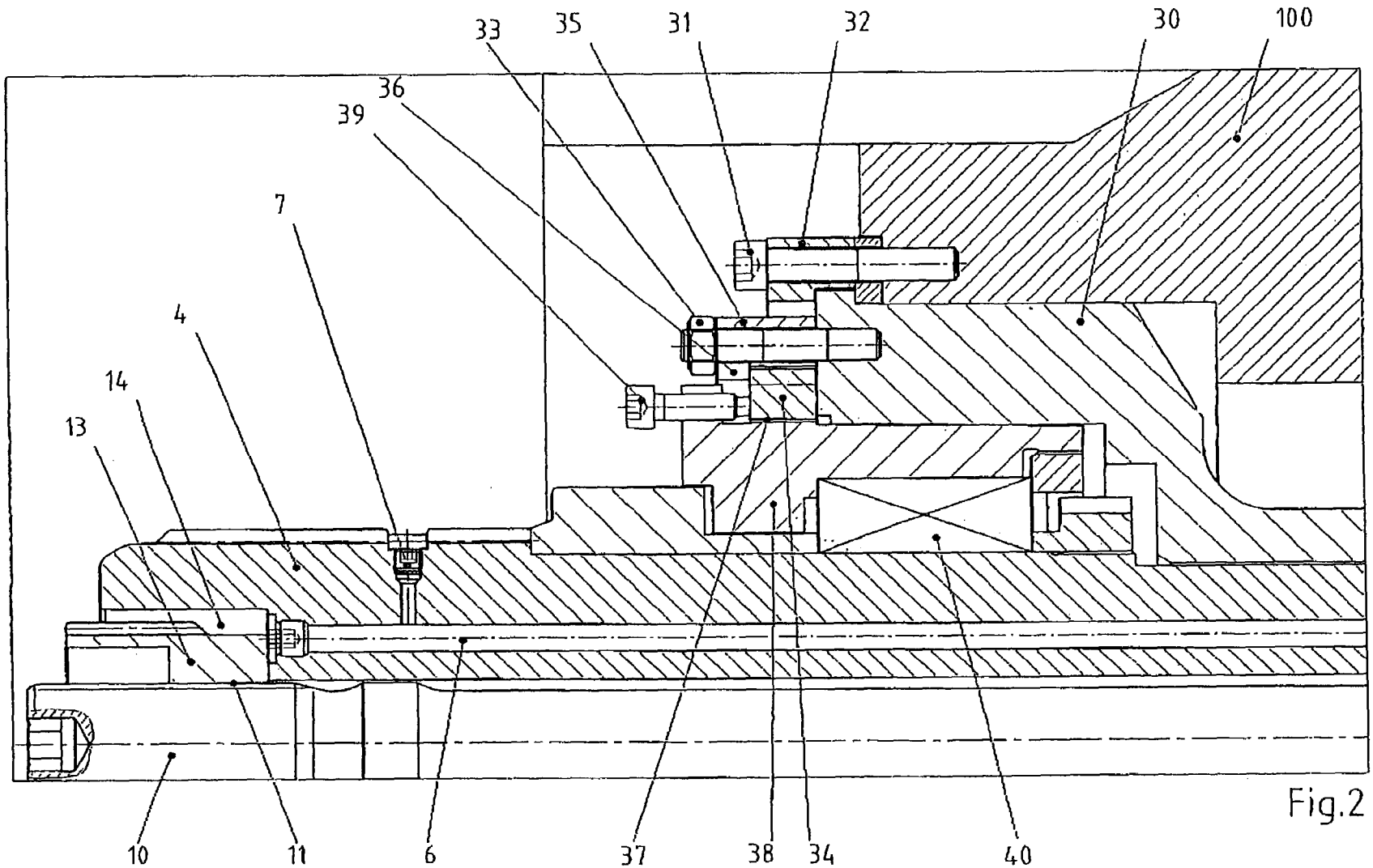
FIG. 2 shows a detail of FIG. 1.

The roll 1 shown is one of three interchangeable working rolls arranged in a star shape around the rolling-stock longitudinal axis. The roll 1 has a hub 2 which is connected to a roll shaft 4 via an interference fit 3 having a taper seat.

In the region of the interference fit 3, an outlet 5 for a fluid, preferably an oil, is provided in the roll shaft 4. The fluid is fed to the outlet 5 through a fluid medium supply 6 which is arranged in the roll shaft 4. Fluid is fed to the fluid medium supply 6 via an inlet 7.

A tie rod 10 is arranged in an axial bore of the roll shaft 4. The tie rod 10 has external threads 11 and 12 at both ends. Sitting on the external thread 11 in a recess 14 of the roll shaft 4 is a nut 13, which bears against the base of the recess 14 on the roll shaft 4. As a result, the nut 13 forms an abutment which transmits axial forces in an axial direction of the roll shaft 4 from the tie rod 10 to the roll shaft 4.

With the other external thread 12, the tie rod 10 engages in a recess of a cap 15. The cap 15 acts on the sleeve 16, which directly adjoins the hub 2 of the roll 1 in the axial direction. The cap 15 can at least partly bear against that end of the roll shaft 4 which is opposite the nut 13. It forms an abutment which transmits axial forces at least in the other axial direction of the roll shaft 4 from the tie rod 10 to a sleeve element. By the connection to the tie rod 10, the connection between the tie rod 10 and the roll shaft 4, and the arrangement of the sleeve 16 relative to the cap 15, a sleeve element is formed which holds the roll 1 in its axial position in a positive-locking manner at least in one direction.

The sleeve 16 has an inner contour running in an at least partly frustoconical manner from the left-hand end, in the figure, to the right-hand end of the sleeve 16. As a result, the sleeve 16 pushed onto the roll shaft 4 forms an interference fit, having a taper seat, with the roll shaft 4.

In addition, the sleeve 16 of the cap 15 is designed as a bearing inner ring of a radial bearing 17, with which the roll shaft 4 is rotatably mounted in the stand housing 100.

A further radial bearing 18 is provided on that side of the hub 2 which is opposite the cap 15 in the axial direction. The inner bearing shell 19 of this radial bearing 18 is designed as a sleeve 20. The sleeve 20 directly adjoins the hub 2 in the axial direction. Furthermore, its inner contour is designed in an at least partly frustoconical manner, so that it forms an interference fit, having a taper seat, with the roll shaft 4.

The sleeve 20 and the sleeve 16, due to their interference fit with the roll shaft 4, form axially fixed limiting elements which hold the hub 2 and thus the roll 1 in their axial position on the roll shaft 4 in a positive-locking manner.

The roll shaft 4 is fixed in the recess, surrounding the roll shaft 4, of the stand housing 100 at least in one axial direction by a releasable retaining means. This retaining means has a first axial fixing by means of an outer ring 32 which encloses a collar 30 and is fixed to the housing 100 with screws 31. A second fixing is formed by an inner ring 35 which is connected with screws 33 to the element (eccentric sleeve) forming the collar 30 and encloses a ring element 34. The inner ring 35 has lugs 36 pointing inward. On its circumference, the ring element 34 has recesses, which enable the lugs 36 to pass through. These recesses are arranged on the circumference of the ring element 34 in such a way that they form with the lugs 36 a bayonet catch axially fixing the ring element 34.

The ring element 34 is connected to a bearing bush 38 via a thread 37. This connection permits connecting positions arranged axially next to one another between the ring element 34 and the bearing bush 38. Rotation of the ring element 34 relative to the bearing bush 38 can be avoided by a clamping screw 39, so that the set connecting position can be fixed.

The bearing bush 38 is axially fixed to the roll shaft 4 via a thrust bearing 40 which permits rotation of the roll shaft 4 relative to the bearing bush 38.

The releasable retaining means, by setting the connecting position between ring element 34 and bearing bush 38, permits axial positioning of the roll shaft 4 relative to the housing 100 and thus permits a fine setting of the position of the roll 1. Due to the bayonet catch, however, the roll shaft 4 can be quickly pulled at least partly out of the recess, surrounding it, of the housing 100.

To dismantle a shaft 1 which is to be replaced, a tool (not shown) is applied to the external thread 11 of the tie rod 10, this external thread 10 being axially supported on the roll shaft 4. The abutment formed by the nut 13 can be relieved by applying a tensile load. As a result, the nut 13 can be released, so that it is possible to move the tie rod 10 relative to the roll shaft 4. However, the tie rod 10 is first of all held in its position by the tensile load applied by the tool.

Then, by putting an adapter onto the inlet 7, oil at 3600 bar is introduced into the fluid medium supply 6 from a fluid supply (not shown). This oil comes out at the outlet 5 and forces the inner circumference of the hub 2 from the roll shaft 4. As a result, the metallic contact between the hub 2 and the roll shaft 4 is neutralized.

The screw 33 is then released, so that the clamping at the bayonet catch is released. The ring element 34 can be rotated relative to the ring 35 and the bayonet catch neutralized. As a result, the roll shaft is axially movable.

By gradually reducing the tensile load applied to the tie rod 10 by the tool, the connection between hub 2 and roll shaft 4 can now be released. First of all the hub 2 and roll 1 are pushed against the connecting stirrup 42 by the restoring force of the interference fit 3 with taper seat. In the process, the interference fit of the sleeve 16 with the roll shaft 4 is released. The interference fit is designed in such a way that the push-on path of this interference fit corresponds approximately to the distance covered by the hub 2 until it comes into contact with the connecting stirrup 42.

By further reduction of the tensile load, the roll shaft 4 is moved away from the sleeve 16 by the restoring force, which continues to act, of the interference fit 3. As a result, the sleeve 20 comes into contact with a shoulder 41. The interference fit between the sleeve 20 and the roll shaft 4 is released by the roll shaft 4 being pushed back further.

Figure 3:
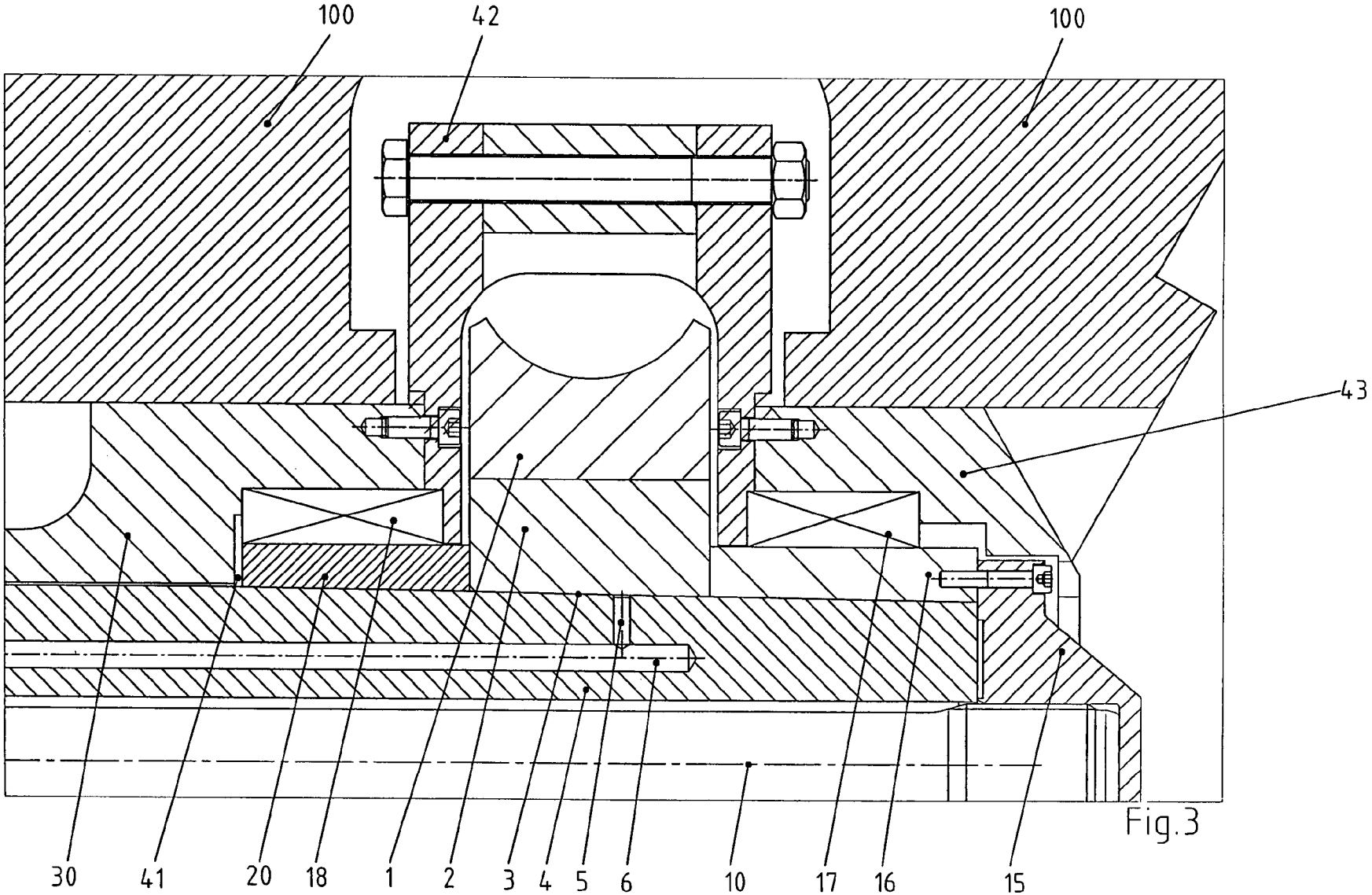
FIG. 3 shows a further detail of FIG. 1.

The roll shaft 4 is moved away from the sleeve 16 by the restoring force of the interference fit 3 until the interference fit 3 is released. After complete reduction of the tensile load, the tie rod 10 can then be unscrewed from the cap 15. To this end, the cap 15 together with the tie rod 10 can be displaced axially in such a way that the screws connecting the sleeve 16 to the cap 15 engage with their heads in correspondingly designed recesses of the eccentric sleeve 43. The insertion of the screws into the recesses of the eccentric sleeve 43 produces a rotary abutment which facilitates the release of the screwed connection between cap 15 and tie rod 10 (cf. FIG. 3).

Figure 4:
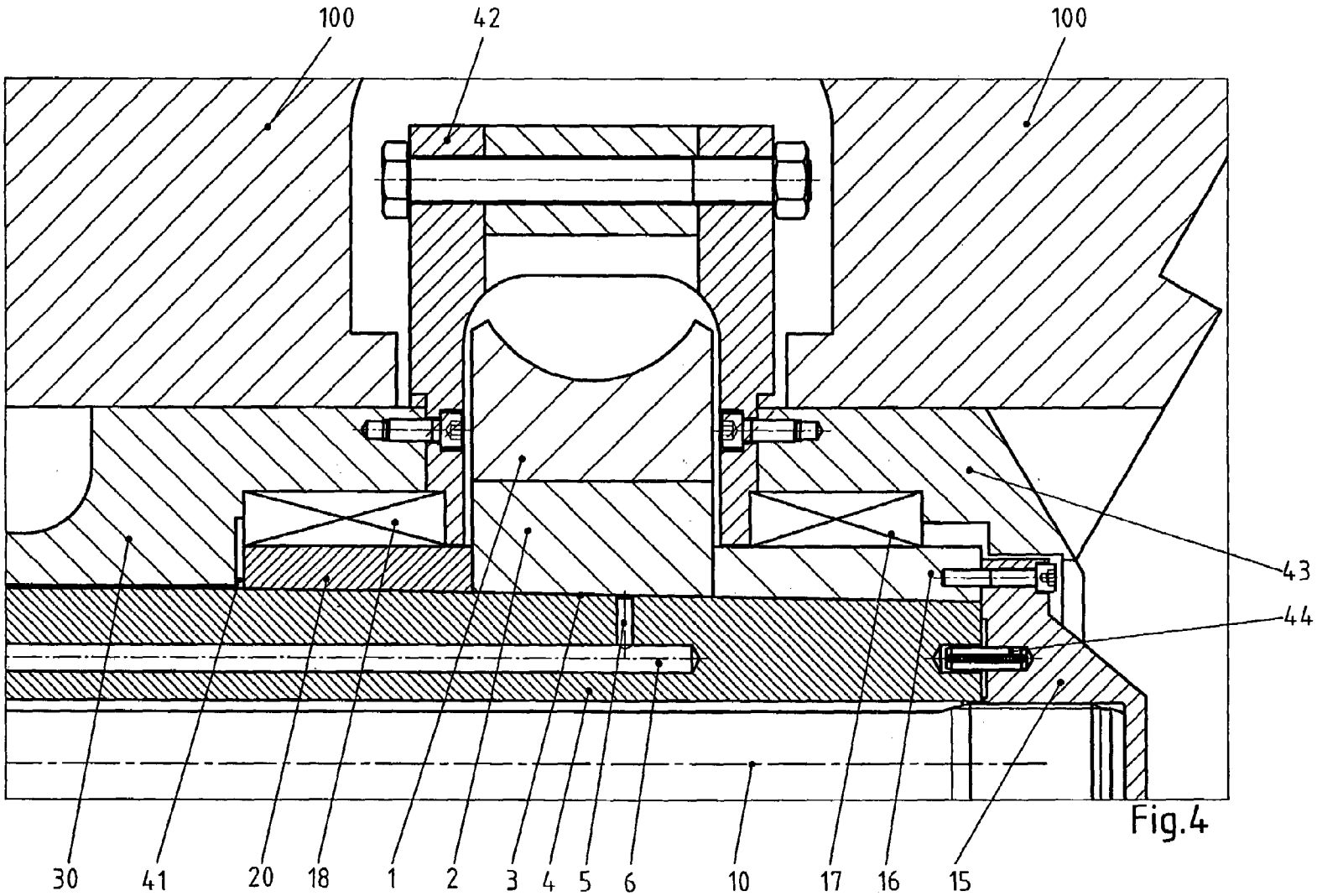
FIG. 4 shows a further embodiment in an axial cross section.

In another preferred embodiment, the anti-rotation locking of the cap 15 is not effected by the engagement of screw heads in recesses of the eccentric sleeve 43 but rather only by pins or clamping sleeves which are arranged parallel to the shaft axis and engage, on the one hand, in holes in the cap 15 and, on the other hand, at the end face in holes arranged in the roll shaft 4 (cf. FIG. 4).

The roll shaft 4 can be pulled out to such an extent that the roll 1 and the hub 2 can be removed. The roll is thus dismantled.

To install a new roll, it is inserted into the free space of the connecting stirrup 42. The roll shaft 4 and the tie rod 10 are then pushed into the hub 2. The tie rod is screwed to the cap 15. By a progressive increase in the tensile load applied to the tie rod 10 by the tool, the sleeve 20, the sleeve-like rim 16 of the cap 15, and the hub 2 are increasingly pushed axially onto the roll shaft 4. The interference fits are formed in the process. After the interference fits have been formed, the hub 2 is fixed axially in a positive-locking manner by the sleeve 20 and the sleeve-like rim 16. There is no risk of the hub 2 being displaced axially by the restoring forces of the interference fit 3. By interruption of the fluid supply, the interference fit 3 settles once the oil located between the inner surface of the hub 2 and the outer surface of the roll shaft has been displaced from the interference fit.

What is claimed:

1. A roll stand for rolling bar-shaped or tubular stock, having a stand housing, having at least one roll which is arranged on a roll shaft rotatably mounted in the stand housing and is connected in a rotationally fixed manner to the roll shaft via a frictional connection by means of a radial interference fit, wherein the roll is held in its axial position on the roll shaft in a positive-locking manner by sleeve elements contacting the roll axially with respect to the roll shaft, wherein at least one of the sleeve elements is connected to the roll shaft via an interference fit, in particular an interference fit having a taper seat.

2. The roll stand as claimed in claim 1, wherein the roll is connected to the roll shaft via an interference fit, in particular via an interference fit having a taper seat.

3. The roll stand as claimed in claim 2, which comprises a fluid medium supply which has an outlet in the region of the interference fit in order to introduce a fluid between roll and the roll shaft.

4. The roll stand as claimed in claim 1, wherein the push-on path of the interference fit of the sleeve element is smaller than the push-on path of the interference fit of the roll.

5. The roll stand as claimed in claim 1, which comprises a tie rod which is guided axially through the roll shaft and which has, at its one end, an abutment transmitting axial forces at least in one axial direction of the roll shaft from the tie rod to one of the sleeve elements and, at its other end, an abutment transmitting axial forces at least in the opposite axial direction of the roll shaft from the tie rod to the roll shaft.

6. The roll stand as claimed in claim 5, which comprises an external thread formed on the end of the tie rod and a nut bearing against the end of the roll shaft.

7. The roll stand as claimed in claim 5, which comprises a cap which encloses the end of the roll shaft, axially adjoins one of the sleeve elements and has a central recess in which the tie rod engages.

8. The roll stand as claimed in claim 7, wherein the recess has an internal thread and the tie rod has an external thread at the end assigned to the cap.

9. The roll stand for rolling bar-shaped or tubular stock, having a stand housing, having at least one roll which is arranged on a roll shaft rotatably mounted in a bearing bush arranged in a recess of the stand housing, and having a retaining means releasably fixing the roll shaft at least in one axial direction in the recess, wherein the retaining means is designed as a bayonet catch, said bayonet catch being formed by a ring having a lug projecting inwards and a ring element having a recess on its outer circumference enabling the lug of the ring to pass through, said ring element being connected to the bearing bush and said ring being connected to said housing.

10. The roll stand as claimed in claim 9, which comprises a clamping means which acts on at least one component of the bayonet catch and prevents opening of the bayonet catch.

11. The roll stand as claimed in claim 9, wherein the roll shaft is rotatably mounted in an eccentric sleeve, the eccentric sleeve being rotatably mounted in a recess of the stand housing.

12. The roll stand as claimed in claim 9, wherein a stepped seat is provided between an element fixed axially on the roll shaft and an element fixed axially to the stand housing.

13. The roll stand as claimed in claim 9, wherein said ring element is connected to the bearing bush in an axially adjustable manner and locking means are arranged for locking the ring element in any position within the range of the axial adjustability.

14. The roll stand as claimed in claim 13, wherein the ring element is connected to the bearing bush in an axially adjustable manner by means of a thread and wherein the locking means are locking screws.

* * * * *